United States Patent [19]

Eriksen et al.

[11] Patent Number: 4,944,351

[45] Date of Patent: Jul. 31, 1990

[54] DOWNHOLE SAFETY VALVE FOR SUBTERRANEAN WELL AND METHOD

[75] Inventors: Erik P. V. Eriksen; Brian K. Drakeley; Michael A. Carmody, all of Broken Arrow, Okla.

[73] Assignee: Baker Hughes Incorporated, Houston, Tex.

[21] Appl. No.: 426,762

[22] Filed: Oct. 26, 1989

[51] Int. Cl.[5] ..... E21B 34/10; E21B 23/00

[52] U.S. Cl. ..... 166/376; 166/55.1; 166/375; 166/385; 166/386; 166/317

[58] Field of Search ..... 166/55, 55.1, 55.7, 166/298, 297, 376, 375, 319, 332, 386, 178, 378, 385, 317, 318

[56] References Cited

U.S. PATENT DOCUMENTS

| | | | |
|---|---|---|---|
| 1,854,477 | 4/1932 | McKissick | 166/317 X |
| 2,922,479 | 1/1960 | Kinley | 166/317 |
| 3,661,207 | 5/1972 | Current et al. | 166/317 X |
| 3,696,868 | 10/1972 | Taylor, Jr. | 166/375 |
| 3,799,258 | 3/1974 | Tausch | 166/322 X |
| 4,031,957 | 6/1977 | Sanford | 166/317 X |
| 4,071,088 | 1/1978 | Mott | 166/375 |
| 4,081,032 | 3/1978 | Hutchison et al. | 166/317 |
| 4,503,913 | 3/1985 | Carmody | 166/332 X |
| 4,796,705 | 1/1989 | Carmody et al. | 166/323 |

*Primary Examiner*—Stephen J. Novosad

*Attorney, Agent, or Firm*—Hubbard, Thurman, Turner & Tucker

[57] ABSTRACT

A method and apparatus for replacing a defective downhole well safety valve of the full bore type by a wireline valve sealably insertable in the bore of the housing for the defective valve by wireline and operating the wireline inserted safety valve by fluid pressure supplied through an existing control fluid passage provided in the original safety valve housing. An internally projecting integral protuberance is provided in the bore of the original safety valve housing and a connecting fluid conduit is provided between the interior of the protuberance and the existing control fluid passage. A cutting tool is mounted on an axially shiftable sleeve disposed immediately above the protuberance. The axially shiftable sleeve is manipulated by an auxiliary tool temporarily inserted in the bore of the original valve housing and causing the cutting tool to remove the protuberance and thus establish fluid communication for the control fluid with the internal bore of the safety valve housing. The insertion of a conventional in-tubing safety valve apparatus will permit such apparatus to be operated by control fluid pressure supplied through the opening provided by the severed or removed protuberance.

12 Claims, 3 Drawing Sheets

DOWNHOLE SAFETY VALVE FOR SUBTERRANEAN WELL AND METHOD

BACKGROUND OF THE INVENTION

1. FIELD OF THE INVENTION:

The invention relates to downhole safety valves for subteranean wells and particularly to a method and apparatus for effecting the replacement of a defective full bore opening safety valve by a secondary safety valve which is sealably inserted in the bore opening of the original safety valve and operated by control fluid supplied through the existing control fluid piping.

2. SUMMARY OF THE PRIOR ART:

A very popular form of downhole well safety valve comprises the so-called "full bore opening" type which refers to a safety valve wherein the bore opening through the valve, when it is disposed in its open position, is substantially equal to the internal bore diameter of the tubing string in which the safety valve is incorporated. Such full bore opening valves may employ a rotatable ball,or a pivoted flapper, as the shiftable valve head. In either case, the valve head is shifted to its full open position by an actuating sleeve which is axially shiftably mounted within the bore of the valve housing and is operated by one or more hydraulic cylinders to shift the actuating sleeve downwardly and effect the movement of the valve head to its full open position. Pressured control fluid for operating the cylinder is supplied from the surface by small diameter pipe or tubing which communicates with a control fluid passage in the wall of the valve housing. Of course, in such full open position, the actuating sleeve is spring biased to its valve closing position.

A valve of this general type is shown in U.S. Pat. Nos. 4,503,913 and 4,796,705. The latter patent provides a secondary actuating cylinder for effecting the locking of the movable head of the safety valve in its full open position in the event of any failure or defect in the operation of the primary cylinder.

It is, of course, necessary to replace the defective safety valve by a functional safety valve and this has been accomplished in the past by inserting so-called in-tubing safety valves within the bore of the original defective safety valve while the original defective valve is in its locked, full open position.

Such replacement valves are generally inserted by wireline, hence the problem arises as to how the already installed control fluid piping can be utilized to effect the control of the replacement valve.

U.S. Pat. No. 3,696,868 discloses an in-tubing replacement valve for an installed defective safety valve wherein the wall of the actuating sleeve for the defective valve is perforated prior to insertion of the replacement valve to provide communication with the existing control fluid conduits. Obviously, the production of perforations in an installed sleeve without damaging surrounding elements is a difficult operation.

Prior art arrangements have also utilized ports in the original valve housing communicating with the control fluid conduit and provided seal elements for such ports or threaded plugs which are removed by the insertion of the replacement safety valve. Obviously, any time that a seal or a threaded plug is employed in a downhole environment, there is the distinct possibility that such seal will leak and produce undesirable effects on an operation of the well.

U.S. Pat. #3,799,258 proposes the utilization of a hollow shearable threaded nipple traversing the wall of the valve housing with the inwardly projecting end of the nipple being sheared off by a sleeve which is moved downwardly by "a suitable tool". This arrangement has several obvious disadvantages.

Since the original safety valve may function properly for many months, the successive passages of well treatment and/or measuring tools dowardly through the safety valve always involves the danger that the inwardly projecting end of the hollow nipple may be accidentally sheared off, thus rendering the installed safety valve inoperative. Furthermore, leakage around the threaded nipple by high pressure, highly corrosive well fluids is a constant threat.

Accordingly, the prior art has not provided an adequate solution to the problem of effecting trouble free fluid communication of control fluid to a replacement in-tubing safety valve through the piping and fluid passages already existing in an installed defective safety valve.

SUMMARY OF THE INVENTION

In accordance with the method and apparatus of this invention, the upper sub of an otherwise conventional safety valve housing, is modified to incorporate a hollow protuberance in the wall of the upper sub at a location above the actuating sleeve. Such upper sub may be that shown in the aforementioned U.S. Pat. #4,796,705, the disclosure of which is incorporated herein by reference. The hollow portion of the protuberance preferably comprises an integral extension of an angularly directed hole passing into the wall of the upper sub and communicating at its lower end with an axially extending fluid passage leading to the cylinders for operating the valve actuating sleeve. At its upper end, the inclined hole is provided with an enlarged counterbore for receiving a conventional nipple connection to a small diameter pipe leading to the well surface and a source of pressurized control fluid. The inclined passage extension projects into the integral protuberance but does not extend through the inner wall of the protuberance.

Such hollow protuberance is preferably provided by first forming an internally projecting annular shoulder in the valve housing, into which the inclined passage extends but does not penetrate. Two axial slots are then broached in the annular shoulder, respectively lying on each side of, but not exposing the inclined passage.

A sleeve is mounted immediately above the hollow protuberance and such sleeve mounts a cutting tool which is vertically aligned with the protuberance by an axial slot in the housing inner wall. A wireline or other carried mechanism is then inserted through the production tubing string of the well and into the bore of the upper sub where the wireline tool seats upon a no-go shoulder provided in the upper sub. The wireline tool incorporates a collet or the like having heads which are restrained in a radially retracted position during the insertion of the wireline tool in the well but are shifted radially outwardly by jarring movements imparted to the wireline carried tool to engage the upper end of the cutting tool sleeve and impart downward jarring forces to such sleeve and the cutting tool, resulting in the severing of the hollow protuberance and the exposure of the hollow bore of such protuberance.

The wireline actuating tool may then be withdrawn from the well and a conventional wireline insertable and retrievable in-tubing safety valve may be inserted and sealably mounted within the bore of the aforementioned upper sub of the original safety valve. Such wireline inserted safety valve has appropriate passage or recess for communication with the open end of the bore of the hollow protuberance. Hence, pressurized control fluid may be supplied from the well surface to operate the wireline inserted and retrievable in-tubing safety valve. Such in-tubing safety valves are well known in the art and form no part of the present invention.

Further advantages of the invention will be readily apparent to those skilled in the art from the following detailed description, taken in conjunction with the annexed sheets of drawings, upon which is shown a preferred embodiment of the invention.

DESCRIPTION OF PREFERRED EMBODIMENT

Figure 1:
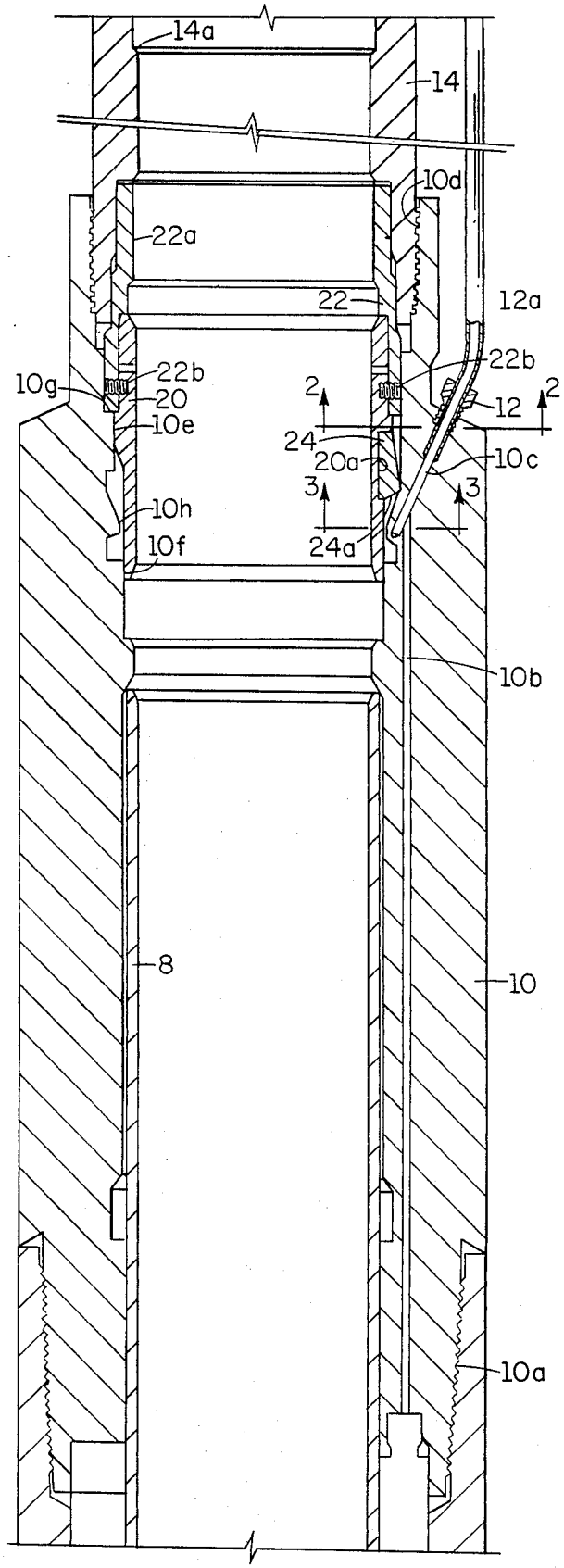
FIG. 1 is a vertical sectional view of a modified top sub for an conventional downhole well safety valve.

Referring to FIG. 1, a top sub 10 which has been modified in accordance with this invention comprises a tubular element having external threads 10*a* at its bottom end for engagement with the tubular body portion 8 of a conventional downhole safety valve, such as a valve shown in the aforementioned U.S Pat. #4,796,705. An actuating sleeve 8 extends upwardly into the bore of top sub 10.

Top sub 10 has a conventional axially extending control fluid passage 10*b* in its wall which terminates at its upper end in inclined passage 10*c* in which a fitting 12 is threadably mounted for securing a pipe 12*a* which extends to a source of pressured control fluid at the well surface.

In accordance with this invention, top sub 10 is provided at its upper end with internal threads 10*d* for engagement with a conventional connecting sub 14 which is conventionally connected to the bottom of a well conduit, such as a production tubing string. Connection sub 14, which could be integral with top sub 10, defines an upwardly facing no-go shoulder 14*a* in the medial portion of the bore. Such no-go shoulder does not constrict the bore of connecting sub 14 to a diameter less than the full bore diameter of the downhole safety valve (not shown) in its open position.

Top sub 10 is further provided at its upper end with an internal annular recess 10*e* in which a cutting tool mounting sleeve 20 is positioned. The internal bore 20*a* of cutting tool sleeve 20 has a greater diameter than the full bore opening of the downhole safety valve. The bottom end of cutting tool sleeve 20 slidably engages an internal bore portion 10*f* of top sub 10 while the upper portion of the cutting tool sleeve 20 is engaged by a retaining sleeve 22 having an inwardly enlarged upper portion 22*a* abutting against the upper end face of the cutting tool sleeve 20. The lower end face of retaining sleeve 22 abuts an inwardly projecting shoulder 10*g* provided in the recess 10*c*. One or more shear screws 22*b* connect the cutting tool sleeve 20 to the retaining sleeve 22.

Figure 3:
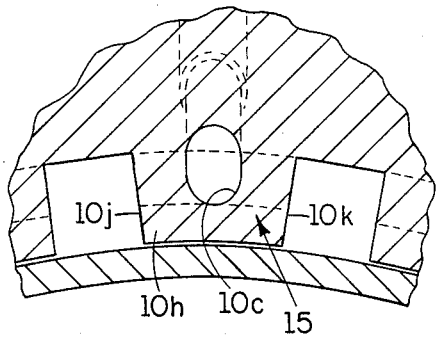
FIG. 3 is an enlarged scale, partial sectional view taken on the plane 3—3 of FIG. 1.

In general alignment with the inclined fluid passage 10*c*, the top sub 10 is provided with an internally projecting, annular shoulder 10*h* which lies below the shoulder 10*g*. The inclined passage 10*c* is extended into this shoulder but does not penetrate the wall of the shoulder 10*h*. Two peripherally spaced, axially extending slots 10*j* and 10*k* are provided through the shoulder 10*g* as shown in FIG.3, these slots being disposed on opposite sides of the inclined passage extension 10*c* and hence defining what will be hereinafter referred to as an internally projecting hollow protuberance 15.

Figure 2:
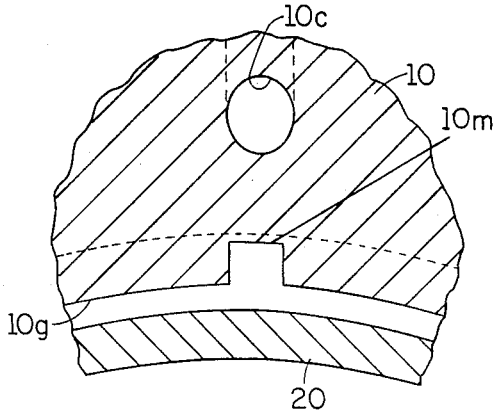
FIG. 2 is an enlarged scale, partial sectional view taken on the 2—2 of FIG. 1.

A cutting tool 24 is mounted in an appropriate recess 20*a* provided on the exterior of the cutting tool sleeve 20 and such cutting tool defines a downwardly facing cutting edge 24*a*. Cutting tool 24 is formed of a tough, hard material, such as tungsten carbide. Cutting tool 24 is held in alignment with the hollow protuberance 15 by being inserted in an axial groove or slot 10*m* provided in the internal shoulder 10*g* (FIG. 2).

It is therefore apparent that when the shear screws 22*b* are sheared, the cutting tool sleeve 20 is free to move axially downwardly and bring the cutting edge 24*a* of cutting tool 24 into cutting engagement with the hollow protuberance 15 and effect the severance of such protuberance, thus leaving the bore of the inclined fluid passage 10*c* open and in communication with the internal bore of the top sub 10. The purpose for providing such communication will be hereinafter described.

Figure 4A:
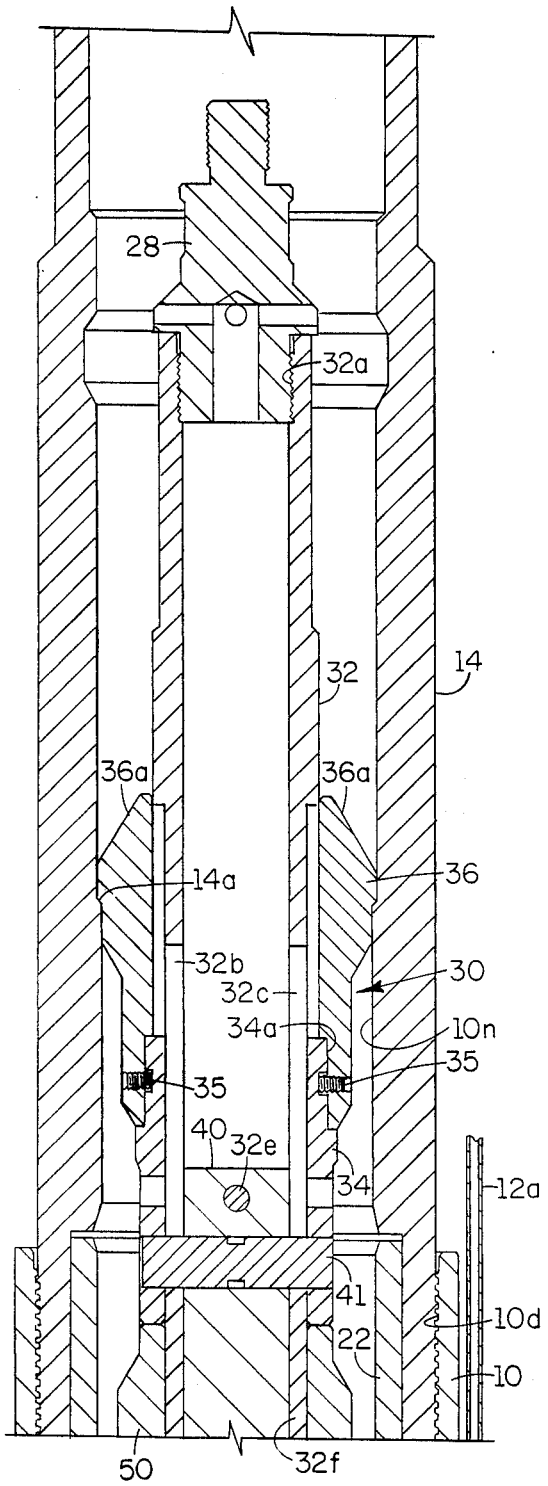
FIGS. 4A and 4B constitute a view similar to FIG. 1 but illustrating the insertion of a wireline tool for engaging a cutting tool incorporated in the modified top sub, the wireline tool being shown in its run-in position.
Figure 4B:
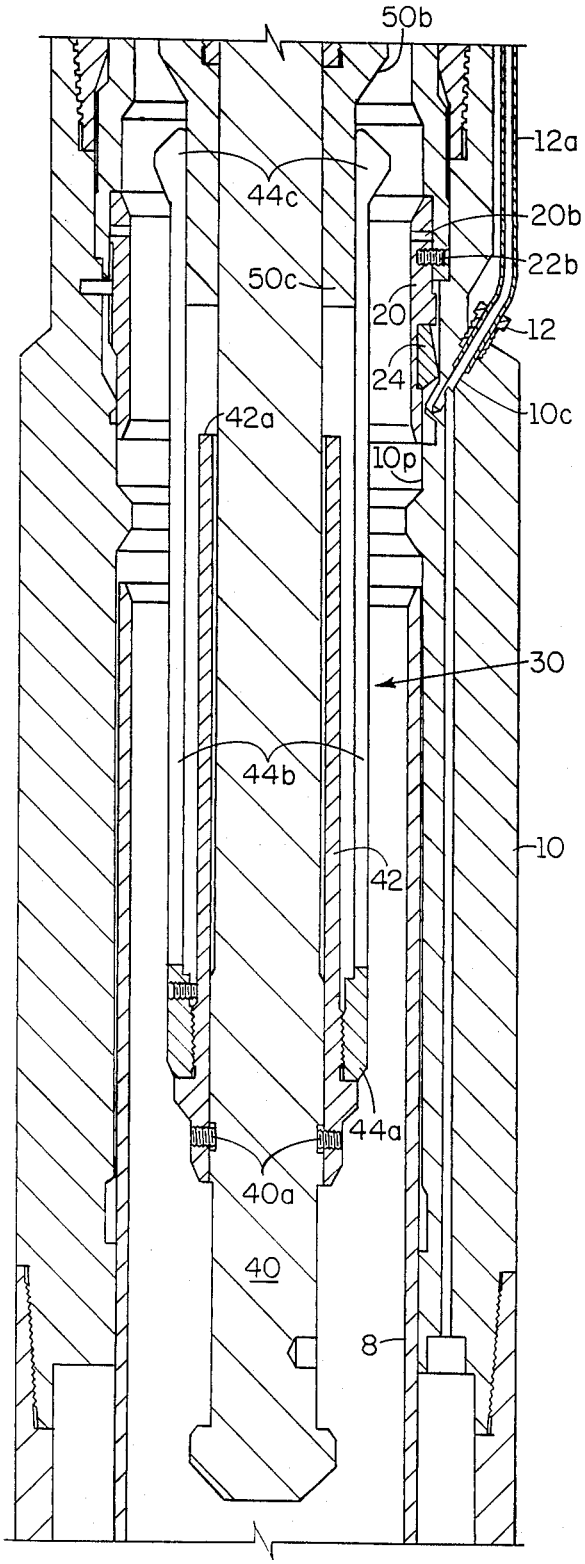

Referring now to FIGS. 4A and 4B, there is shown a wireline suspended tool 30 in its run-in position which has been lowered through the well conduit or production tubing to bring a plurality of radially expandable heads 36*a* of a collet 36 into engagement with the no-go shoulder 14*a* provided in the connecting sub 14. Wireline tool 30 further comprises an inner sleeve 32 threadably secured at its upper end 32*a* to a wireline connection element 28 by which wireline engagement of the tool 30 can be effected. Surrounding the lower end of inner sleeve 32 is an outer sleeve 34 which is connected by screws 35 at its upper end 34*a* with the ring portion 36*b* of the collet 36.

A mandrel 40 is provided which projects into the bore of the inner sleeve 32 and is secured for axial comovement to the outer sleeve 34 by a transverse pin 41 which projects through diametrically opposed, axial slots 32*b* and 32*c* provided in the inner sleeve 32 of the wireline tool 30. Thus, downward movement of the inner sleeve 32 can be effected independently of the mandrel 40, but for run-in, a shear pin 32*e* secures mandrel 40 to inner sleeve 32.

Mandrel 40 has an upwardly extending collet mounting sleeve 42 secured to its lower portion by one or more shear screws 40*a*. In turn, the ring portion 44*a* of a collet 44 is threadably secured by threads 42*a* and set screws 42*b* to the exterior of the collet support sleeve 42. Collet 44 has a plurality of peripherally spaced, axially extending resilient arms 44*b* which terminate in outwardly enlarged head portions 44*c*. Such head portions are disposed above the upper end of the cutting tool sleeve 20 when the run-in tool is engaged with the no-go shoulder 14*a* as shown in FIG. 4.

An actuating sleeve 50 is secured by to the bottom end of the inner sleeve 32, so that the actuating sleeve 50 is effectively an extension of inner sleeve 32. Actuating sleeve 50 has an enlarged upper end portion defining an outwardly inclined camming surface **50*b*. Actuating sleeve 50 also has a lower cylindrical portion 50*c* normally underlying the upper ends of collet arms 44*b* and enlarged collet heads 44*c***.

Figure 5A:
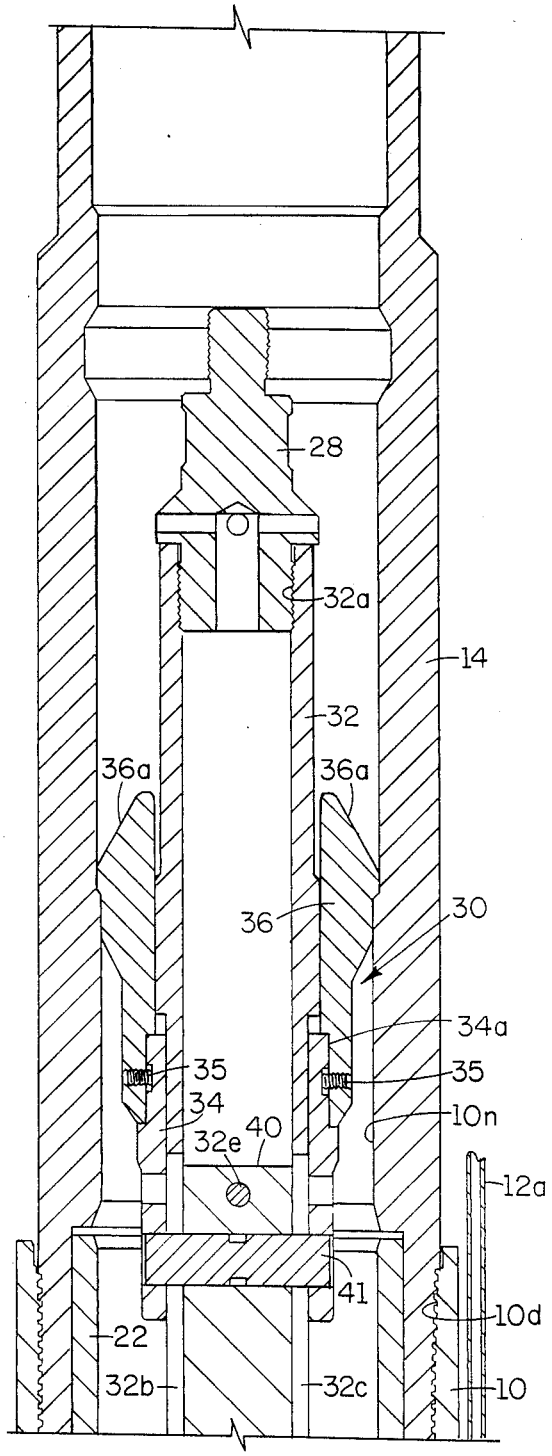
FIGS. 5A and 5B constitute a view similar to FIG. 4 but showing the wireline tool after it has been engaged with the cutting tool in the modified sub and has actuated such cutting tool.
Figure 5B:
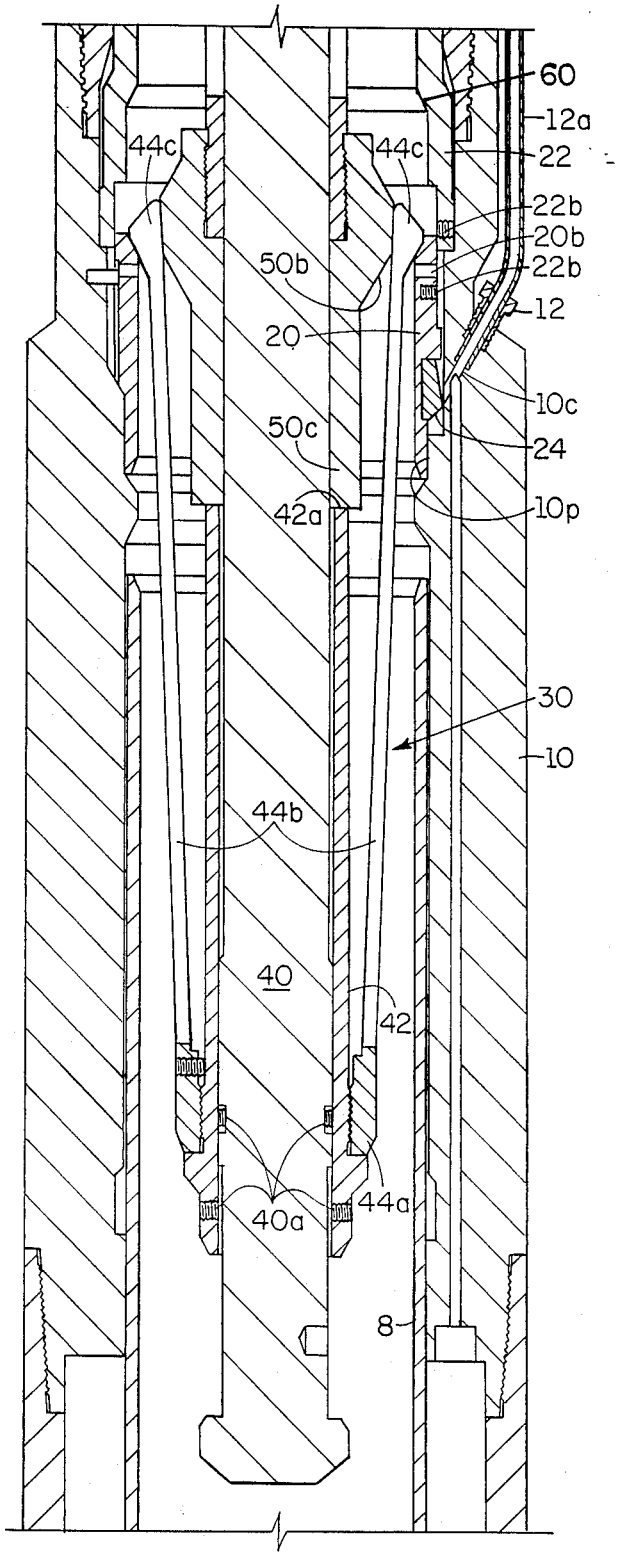

Referring now to FIGS. 5A and 5B, the operation of the wireline tool 30 to achieve the removal of the hollow protuberance 15 by cutting tool 24 can be readily understood. Downward jarring movements imparted in conventional fashion by jars (not shown) incorporated in the wireline suspending the wireline tool 30 will shear pin **32*e* and move the inner sleeve 32 and the inclined surface 50*b* on the actuating sleeve 50 into engagement with the inner surfaces of the enlarged collet heads 44*c*. Such heads are thus moved into engagement with an inclined upper end surface 20*b* provided on the cutting tool sleeve 20. Such downward jarring forces will effect the shearing of shear screws 22*b*, thus permitting the cutting tool sleeve 20 to move downwardly and bring the cutting tool 24 into engagement with the hollow protuberance 15, thus severing such protuberance as indicated in FIG. 5B**.

After the severing of the hollow protuberance 15, the wireline tool 30 can be removed from the well by a simple upward movement of the tubing string. The collet heads **44*c* will continue travel until they contact a shoulder 60. Thereafter, further movement of the wireline will move the sleeve upwardly, thus releasing the collet 44, which will then be permitted to move downwardly, and the mounting sleeve 42 will no-go the mandrel 40**, and the collet assembly thus becomes collapsed.

A conventional in-tubing safety valve (not shown) is then run into the well and effects sealing engagement with bore surfaces, such as **10*n* and 10*p* defined in the upper sub 10, and thus effectively seal off any control fluid entering the bore of upper sub 10 through the now severed end of the hollow protuberance 15. Such control fluid can then be directed in conventional manner to the actuating cylinder elements of the inserted in-tubing safety valve. Such insertable and retrievable in-tubing safety valves are well known in the art and further description or illustration thereof is deemed to be unnecessary. Thus the application of a pressured control fluid through the control fluid pipe 12*a*** extending to the well surface can effect the opening of the inserted intubing safety valve, while such valve will return to its closed position in conventional manner under the bias of a spring and the pressure of well fluids.

It is therefore readily apparent that this invention provides a highly desirable method and apparatus for effecting a connection to existing control fluid conduits provided in the top sub of a downhole safety valve so that such control fluid conduits can be utilized to operate a subsequently inserted intubing safety valve.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. The method of establishing communication with a control fluid conduit provided in the tubular wall of a fluid pressure operated downhole tool comprising the steps of:

providing an annular internal shoulder on the inner surface of said tubular wall;

extending a portion of said control fluid conduit into, but not through said shoulder so that the inner end of said extension portion is disposed within the bore of said tubular wall; and removing said shoulder in its downhole location by an auxiliary tool to expose the bore of said extension portion of said control fluid conduit.

2. The method of claim 1 further comprising the steps of:

mounting the cutting tool on a sleeve;

inserting said sleeve in the bore of said tubular wall of said well tool at the well surface; and actuating said sleeve in its downhole location to move said cutting tool through said shoulder.

3. The method of claim 2 further comprising the steps of:

providing a no-go shoulder on the inner surface of said tubular wall at a location vertically adjacent said sleeve;

providing a wireline tool comprising on outer sleeve having an external shoulder engagable with said no-go shoulder, an inner sleeve telescoped within said outer sleeve and having an upper end rigidly connected to a wireline having serially connected jars therein, and a mandrel traversing the bore of said inner sleeve but secured to said outer sleeve by a pin traversing an axial slot in said inner sleeve, said mandrel carrying a collet having spring biased heads disposed adjacent said cutting tool sleeve in a radially retracted position when said wireline tool engages said no-go shoulder;

shearably securing said inner sleeve to said mandrel;

lowering said wireline tool into the well to engage said outer sleeve with said no-go shoulder;

imparting downward jarring forces by said wireline to said inner sleeve to release the shearable securement of said inner sleeve and said mandrel; and moving said inner sleeve into engagement with said collet heads to radially expand said collet heads into abutting engagement with said cutting tool sleeve, whereby further downward jarring movements of said wireline effects the cutting off of said shoulder by said cutting tool.

4. Apparatus for effecting the downhole severing of a radially, inwardly directed hollow protuberance on the tubular wall of a valve housing, said tubular wall also defining a no-go shoulder above said protuberance comprising, in combination:

a tool sleeve axially slidably mounted within said tubular wall above said hollow protuberance;

a cutting tool mounted on said tool sleeve in axial alignment with said hollow protuberance;

an outer sleeve assembly having an external shoulder engagable with said no-go shoulder;

an inner sleeve assembly telescopically traversing said outer sleeve;

means on the top end of said inner sleeve for rigid connection to a wireline incorporating a jar mechanism;

a mandrel telescopically inserted through said inner sleeve assembly;

a collet having a ring portion and peripherally spaced, axially extending collet arms terminating in enlarged head portions;

means for securing said collet ring portion to said mandrel with said enlarged head portions disposed above and adjacent to said tool sleeve;

means including an axially extending slot in said inner sleeve for rigidly connecting said outer sleeve and said mandrel;

shearable means for securing said inner sleeve relative to said mandrel and outer sleeve during run-in; and means on said inner sleeve assembly for radially expanding said collet heads into operative engagement with said tool sleeve, whereby downward jarring movement imparted to said inner sleeve by said wireline shears said shearable means, engages said collet heads with said tool sleeve and moves said cutting tool through said protuberance.

5. In a full bore downhole safety valve for a subterranean well having a tubular upper sub defining in its wall a downwardly extending fluid conduit for transmitting control fluid to a fluid pressure cylinder for shifting a valve actuator sleeve within the bore of the upper sub to its valve opening position, said valve actuator sleeve having a bore sized to permit passage of wireline tools through the bore opening of the full bore safety valve, the improvement comprising:

an annular recess in the inner wall of said upper sub above the uppermost position of the valve actuator sleeve;

an integral hollow protuberance projecting radially into said annular recess but terminating short of the bore diameter of said valve actuator sleeve, thereby eliminating interference with wireline tools to be passed through the full bore safety valve;

said hollow portion of said protuberance communicating with said control fluid conduit;

a cutting tool sleeve mounted in said annular recess for axial movement;

said cutting tool sleeve having an inner bore diameter not less than said valve actuator sleeve;

a cutting tool fixedly mounted on said cutting tool sleeve and engagable with said protuberance in cutting relation by downward movement of said cutting tool sleeve; and wireline carried means for imparting downward jarring forces to said cutting tool sleeve for severing said protuberance and establishing fluid communication between the bore of the upper sub and said control fluid conduit.

6. The apparatus of claim 5 wherein said wireline carried means comprises:

a no-go shoulder in the bore of said upper sub above said cutting tool sleeve;

an outer sleeve assembly having an external shoulder engagable with said no-go shoulder;

an inner sleeve assembly telescopically traversing said outer sleeve;

means on the top end of said inner sleeve for rigid connection to a wireline incorporating a jar mechanism;

a mandrel telescopically inserted through said inner sleeve assembly;

a collet having a ring portion and peripherally spaced, axially extending collet arms terminating in enlarged head portions;

means for securing said collet ring portion to said mandrel with said enlarged head portions disposed above and adjacent to said tool sleeve;

means including an axially extending slot in said inner sleeve for rigidly connecting said outer sleeve and said mandrel;

shearable means for securing said inner sleeve relative to said mandrel and outer sleeve during run-in; and means on said inner sleeve assembly responsive to downward movement of said inner sleeve assembly after shearing of said shearable means for radially expanding said collet heads into operative engagement with said tool sleeve.

7. The apparatus of claim 5 further comprising axially extending groove means in the interior of said tubular wall for securing said cutting tool in an angular position where said cutting tool is aligned with said hollow protuberance.

8. The apparatus of claim 5 wherein said integral hollow protuberance comprises an internally projecting annular shoulder in the bore of said upper sub;

a hole drilled through the wall of said upper sub into, but not through, said annular shoulder; and a pair of axially extending, peripherally spaced slots cut through said annular shoulder to define said protuberance between said axial slots.

9. The apparatus of claim 8 further comprising axially extending groove means in the interior of said tubular wall for securing said cutting tool in an angular position where said cutting tool is aligned with said hollow protuberance.

10. The method of providing communication with a fluid passage disposed in the tubular wall of an installed downhole well tool comprising the steps of:

(1) prior to installation of the downhole tool;

(a) providing integral annular internal shoulder on the tubular wall of the downhole tool adjacent said fluid passage;

(b) drilling a hole through said tubular wall to communicate with said fluid passage and extend into, but not through said annular internal shoulder;

(2) installing said downhole tool in the well; and (3) axially cutting a slot in said annular shoulder, said slots traversing the inner end of said hole to provide fluid communication with said axial passage.

11. The method of providing communication with a fluid passage disposed in the tubular wall of an installed downhole well tool comprising the steps of:

(1) prior to installation of the downhole tool;

(a) providing integral annular internal shoulder on the tubular wall of the downhole tool adjacent said fluid passage;

(b) drilling a hole through said tubular wall to communicate with said fluid passage and extend into, but not through said annular internal shoulder;

(c) mounting a cutting tool in said down hole tool axially adjacent the inner end of said hole;

(2) installing said downhole tool in the well; and (3) axially moving said cutting tool by wireline into cutting engagement with said shoulder to cut a slot therethrough to expose the inner end of said hole.

12. The method of establishing communication with a control fluid conduit provided in the tubular wall of a fluid pressure operated downhole tool comprising the steps of:

providing an internally projecting integral protuberance on the inner surface of said tubular wall;

extending a portion of said control fluid conduit into, but not through said protuberance so that the inner end of said extension portion is disposed within the bore of said tubular wall;

removing said protuberance in its downhole location by an auxiliary tool to expose the bore of said extension portion of said control fluid conduit;

mounting the cutting tool on a sleeve;

inserting said sleeve in the bore of said tubular wall of said well tool at the wall surface;

actuating said sleeve in its downhole location to move said cutting tool through said protuberance;

providing a no-go shoulder on the inner surface of said tubular wall at a location vertically adjacent said sleeve;

providing a wireline tool comprising an outer sleeve having an external shoulder engagable with said no-go shoulder, an inner sleeve telescoped within said outer sleeve and having an upper end rigidly connected to a wireline having serially connected jars therein, and a mandrel traversing the bore of said inner sleeve but secured to said outer sleeve by a pin traversing an axial slot in said inner sleeve, said mandrel carrying a collet having spring biased heads disposed adjacent said cutting tool sleeve in a radially retracted position when said wireline tool engages said no-go shoulder;

shearably securing said inner sleeve to said mandrel;

lowering said wireline tool into the well to engage said outer sleeve with said no-go shoulder;

imparting downward jarring forces by said wireline to said inner sleeve to release the shearable securement of said inner sleeve and said mandrel; and moving said inner sleeve into engagement with said collet heads to radially expand said collet heads into abutting engagement with said cutting tool sleeve, whereby further downward jarring movements of said wireline effects the cutting off of said protuberance by said cutting tool.

* * * * *